US007699505B2

(12) United States Patent
Yang

(10) Patent No.: US 7,699,505 B2
(45) Date of Patent: Apr. 20, 2010

(54) BALLOON LAMP

(75) Inventor: Jerry S. C. Yang, Taichung (TW)

(73) Assignee: Smart Electronics Works Co., Ltd., Chang Hua Hsien (TW)

( * ) Notice: Subject to any disclaimer, the term of this patent is extended or adjusted under 35 U.S.C. 154(b) by 182 days.

(21) Appl. No.: 12/103,147

(22) Filed: Apr. 15, 2008

(65) Prior Publication Data

US 2009/0257227 A1 Oct. 15, 2009

(51) Int. Cl.
*F21V 1/06* (2006.01)
*A63H 3/06* (2006.01)

(52) U.S. Cl. ..... 362/352; 362/154; 362/186; 362/311.02; 446/222

(58) Field of Classification Search ..... 362/154, 362/186, 311.02, 352; 446/222; 116/210; 273/458

See application file for complete search history.

(56) References Cited

U.S. PATENT DOCUMENTS

| | | | | |
|---|---|---|---|---|
| 1,521,161 | A * | 12/1924 | Marshall | 362/124 |
| 1,530,923 | A * | 3/1925 | Anns | 446/222 |
| 2,664,667 | A * | 1/1954 | Burroughs | 446/222 |
| 4,661,081 | A * | 4/1987 | Basseches | 446/222 |
| 4,798,554 | A * | 1/1989 | Nelson et al. | 446/222 |
| 5,117,344 | A * | 5/1992 | Perez | 362/352 |
| D329,261 | S * | 9/1992 | Pollack | D21/440 |
| 5,295,891 | A * | 3/1994 | Schalk | 446/222 |
| 6,375,534 | B1 * | 4/2002 | Burns | 446/222 |
| 7,344,267 | B2 * | 3/2008 | Carito | 446/222 |
| 7,364,488 | B2 * | 4/2008 | Mueller et al. | 446/222 |
| 2006/0291217 | A1 * | 12/2006 | Vanderschuit | 362/363 |

* cited by examiner

*Primary Examiner*—Ismael Negron
(74) *Attorney, Agent, or Firm*—Pai Patent & Trademark Law Firm; Chao-Chang David Pai

(57) ABSTRACT

A balloon lamp includes a holder base, a balloon shade affixed to the holder base at the top, a balloon connector mounted in the balloon shade to secure a balloon, a power supply unit mounted in the holder base, and one or more LEDs installed in the balloon shade or the holder base and electrically connected to the power supply unit to emit light toward the balloon, thus producing a lighting effect.

13 Claims, 8 Drawing Sheets

BALLOON LAMP

BACKGROUND OF THE INVENTION (a) Field of the Invention

The present invention relates to lamps and more particularly to a balloon lamp that has an inflated balloon secured thereto and that uses LEDs to emit light through the balloon, thus creating a unique atmosphere through the lighting effect.

(b) Description of the Prior Art

A conventional decorative lighting fixture generally comprises a power base, a light emitting device, a reflector and a lampshade. The light emitting device can be a tungsten bulb or incandescent lamp installed in the power base. The reflector is provided at the back side of the light emitting device. The lampshade is provided at the front side of the light emitting device. On a special occasion such as a wedding ceremony or a birthday party, balloons may be used for decoration. However, decorative balloons cannot product lighting effects. In order to produce lighting effects, decorative lighting fixtures must be installed. However, regular decorative lighting fixtures cannot be used with decorative balloons in a close range because the tungsten bulbs or incandescent lamps of regular decorative lighting fixtures produce heat that could damage the balloons.

SUMMARY OF THE INVENTION

The present invention has been accomplished under the circumstances in view. It is the main object of the present invention to provide a balloon lamp which provides a new lamp structure design to secure an inflated balloon and utilizes LEDs to emit light upon or through the balloon, for use as a decorative item on a special occasion such as a wedding ceremony, a birthday party, etc. to create a unique atmosphere through the lighting effect.

To achieve this and other objects of the present invention, the balloon lamp comprises a holder base, a balloon shade, a balloon connector, a light source formed of at least one light emitting diode, and a power supply unit. The holder base and the balloon shade are fastened together, and used for displaying as well as positioning purposes. The balloon shade is connected to the holder base at a selected location, defining a recessed chamber for receiving a balloon. The balloon connector is provided inside the recessed chamber of the balloon shade, having at least one connecting means for securing a balloon. The light source, i.e. the light emitting diodes, are mounted in the recessed chamber of the balloon shade to emit light upon or through the balloon that is received in the recessed chamber of the balloon shade, producing a lighting effect. The power supply unit can be a DC power module or an AC to DC power adapter that provides the necessary working voltage of the light emitting diodes.

DETAILED DESCRIPTION OF THE PREFERRED EMBODIMENTS

Figure 1:
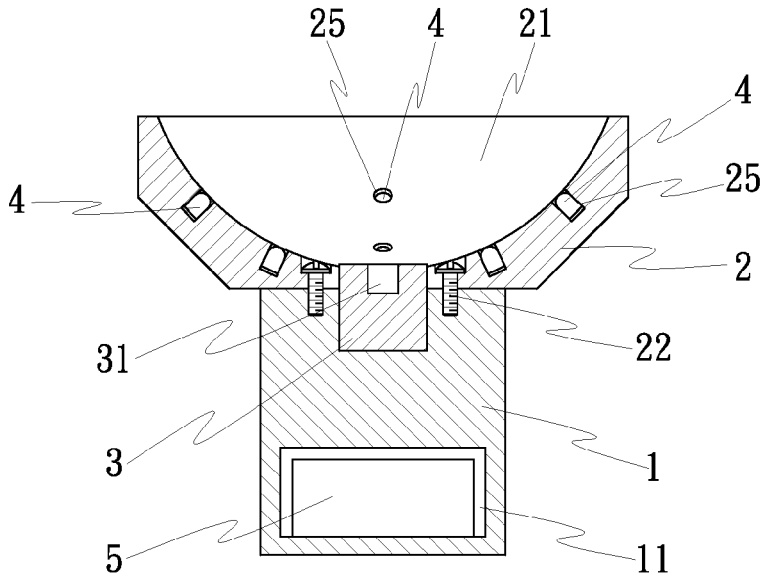
FIG. 1 is a schematic sectional view showing the basic structure of a balloon lamp according to the present invention (before installation of a balloon).
Figure 2:
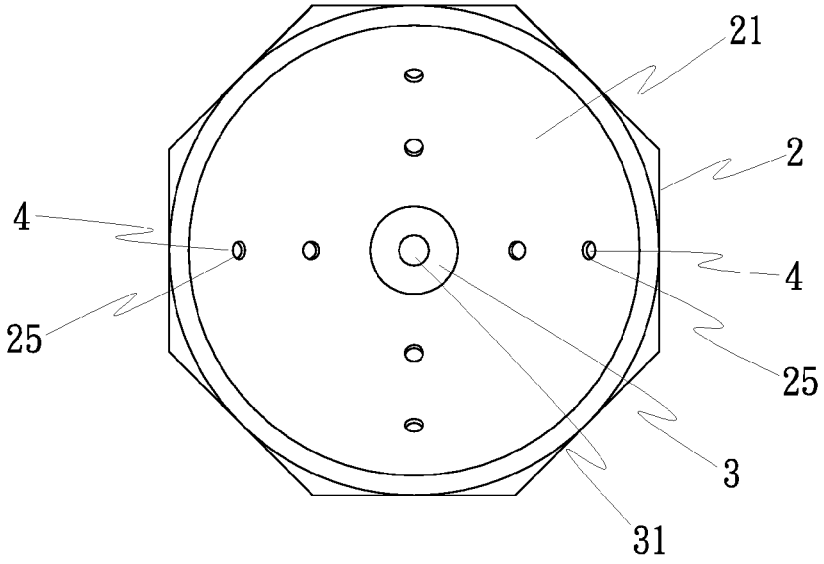
FIG. 2 is a top view of FIG. 1.

Referring to the annexed drawings in detail, a balloon lamp in accordance with the present invention comprises a holder base 1, a balloon shade 2, a balloon connector 3, at least one, for example, a plurality of LEDs (light emitting diodes) 4, a power supply unit 5, and a balloon 6. When the balloon 6 is inflated with a gas and the LEDs 4 are electrically connected to emit light, the balloon lamp provides desirable lighting effects.

Figure 4:
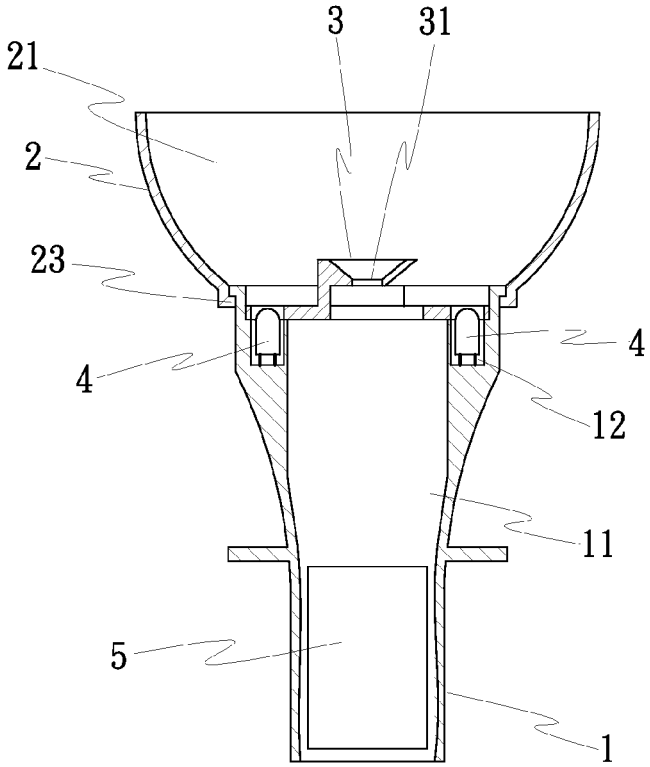
FIG. 4 is a schematic sectional view of a balloon lamp in accordance with a first embodiment of the present invention (before installation of a balloon).
Figure 6:
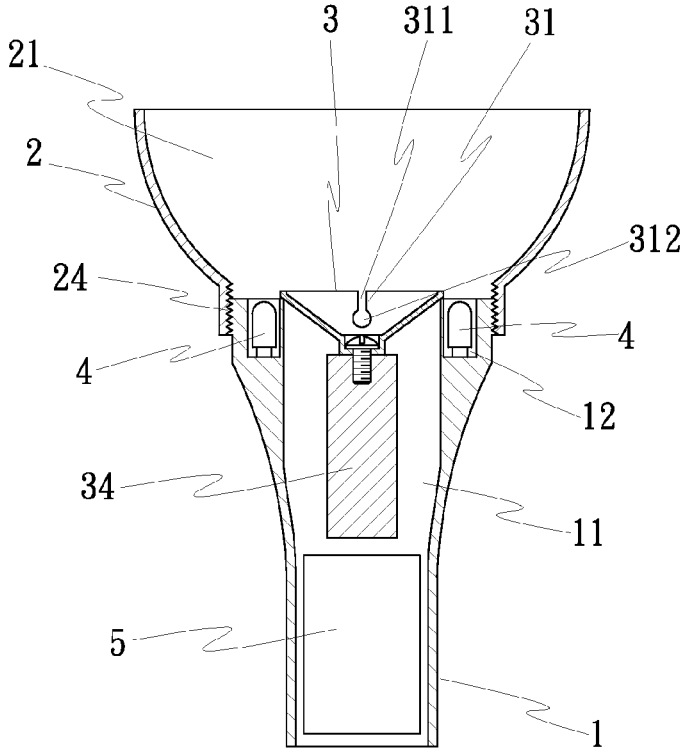
FIG. 6 is a schematic sectional view of a balloon lamp in accordance with a second embodiment of the present invention (before installation of a balloon).

The holder base 1, as shown in FIGS. 1 and 4, is a member adapted to hold the whole assembly of the balloon lamp in place. The holder base 1 can be made in any of a variety of shapes, and provided at the bottom side of the balloon shade 2. As illustrated in FIG. 1, the holder base 1 has a chamber 11 at the center that can be made in communication with the inner space of the balloon shade 2 (see FIG. 6).

Figure 8:
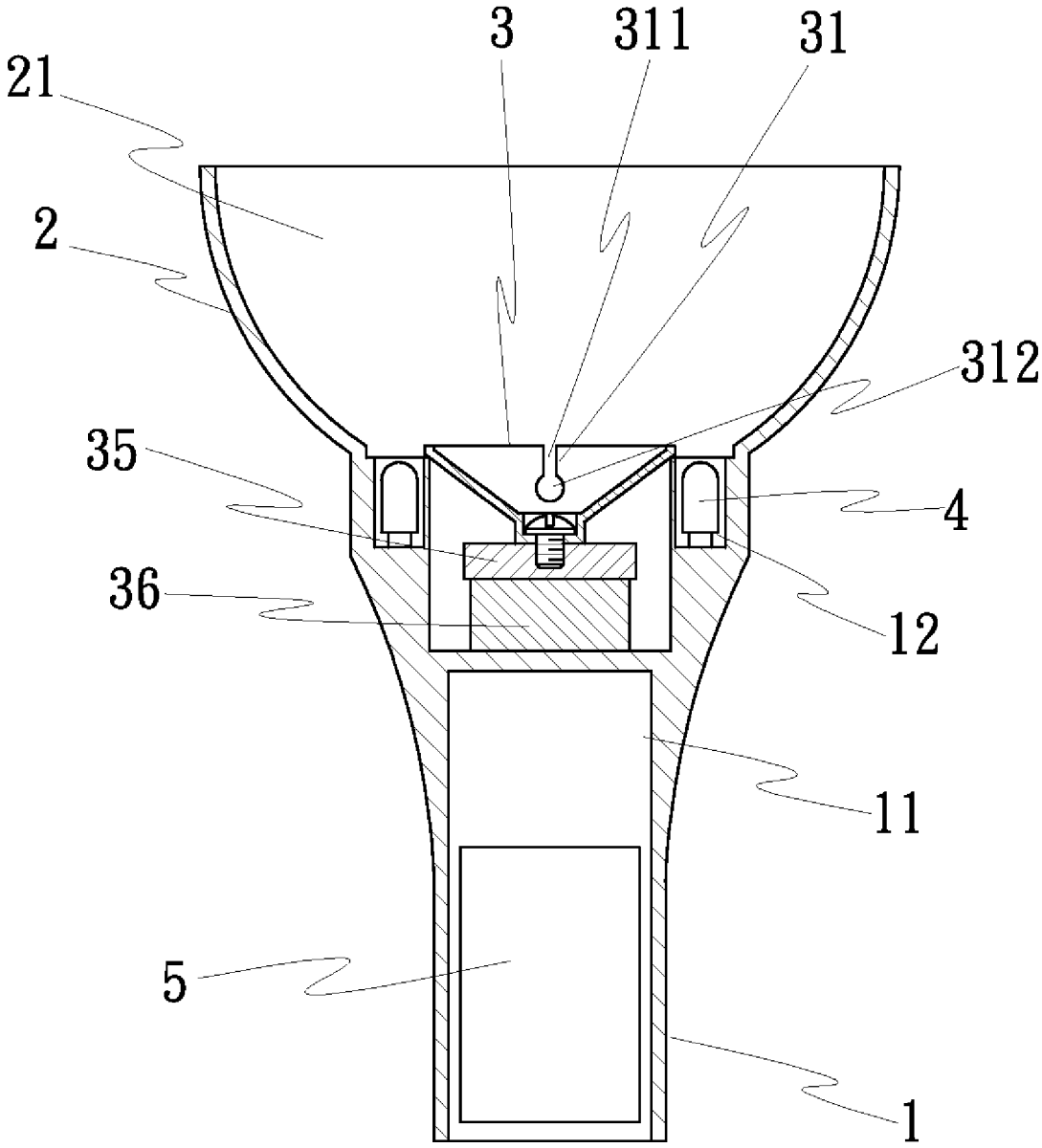
FIG. 8 is a schematic sectional view of a balloon lamp in accordance with a third embodiment of the present invention (before installation of a balloon).

The balloon shade 2, as shown in FIG. 1 or FIG. 4, is fastened to the top side of the holder base 1, defining a recessed chamber 21 for receiving the balloon 6. The recessed chamber 21 can be made in a semispherical shape or any other shape; it can be isolated from the chamber 11 of the holder base 1 (see FIG. 1) or disposed in communication with the chamber 11 of the holder base 1 (see FIG. 4). The balloon shade 2 and the holder base 1 may be directly molded from plastics into one integral piece (see FIG. 8). Alternatively, the holder base 1 and the balloon shade 2 can be separately made and then fastened together with screws 22 (see FIG. 1) or by means of a plug joint 23 (see FIG. 4) or a screw joint 24 (see FIG. 6).

The balloon connector 3, as shown in FIG. 1, is fixedly mounted in the recessed chamber 21 inside the balloon shade 2, having at least one connecting portion 31 for securing the balloon 6. Preferably, as shown in FIG. 4, the balloon connector 3 is made in the form of a conical disk, and the connecting portion 31 is provided at the center of the conical disk and has a center hole 312 and a narrow notch 311 radially extending from the center hole 312 to the periphery (see FIG. 5). Thus, the balloon 6 can be fastened to the center hole 312 and the radial notch 311 of the connecting portion 31.

Figure 7:
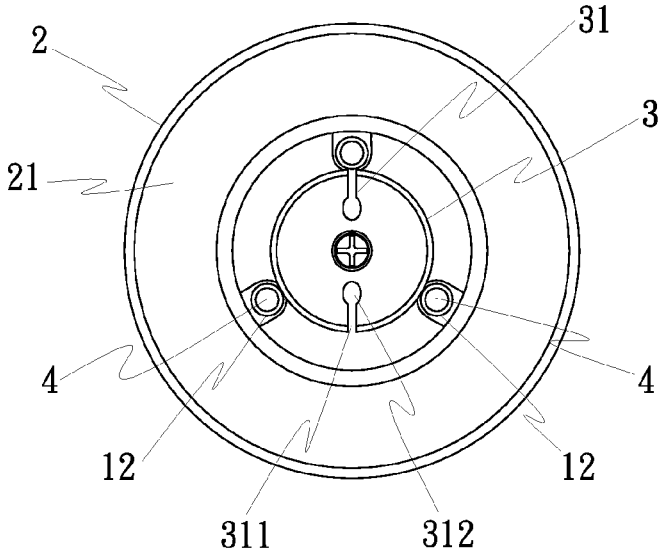
FIG. 7 is a top view of FIG. 6.
Figure 9:
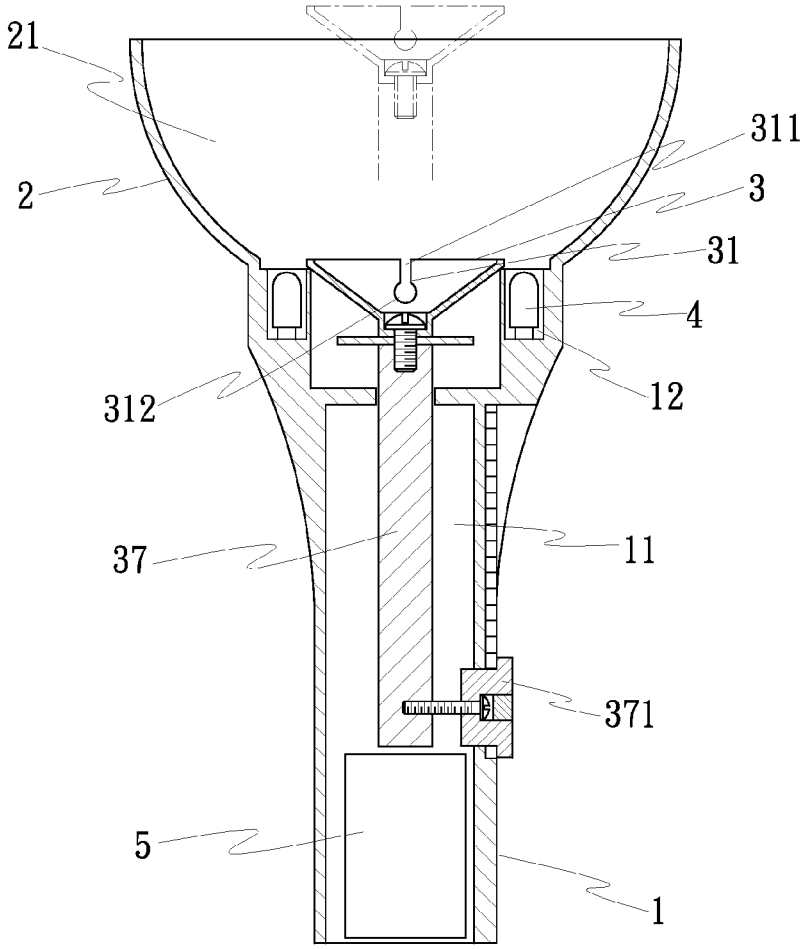
FIG. 9 is a schematic sectional view of a balloon lamp in accordance with a fourth embodiment of the present invention (before installation of a balloon).
Figure 10:
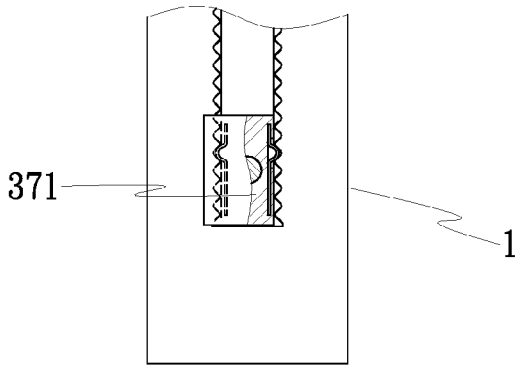
FIG. 10 is an enlarged view of a part of FIG. 9.
Figure 11:
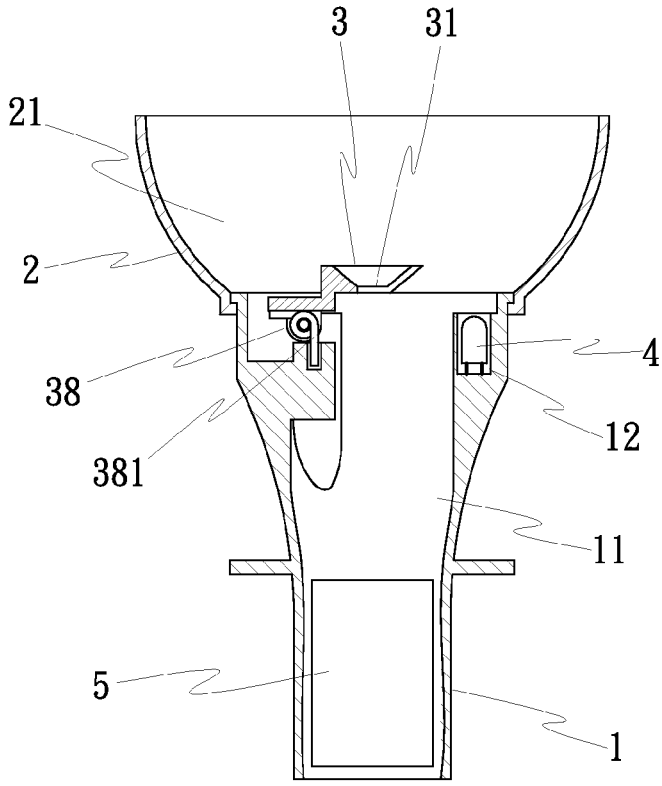
FIG. 11 is a schematic sectional view of a balloon lamp in accordance with a fifth embodiment of the present invention (before installation of a balloon).
Figure 12:
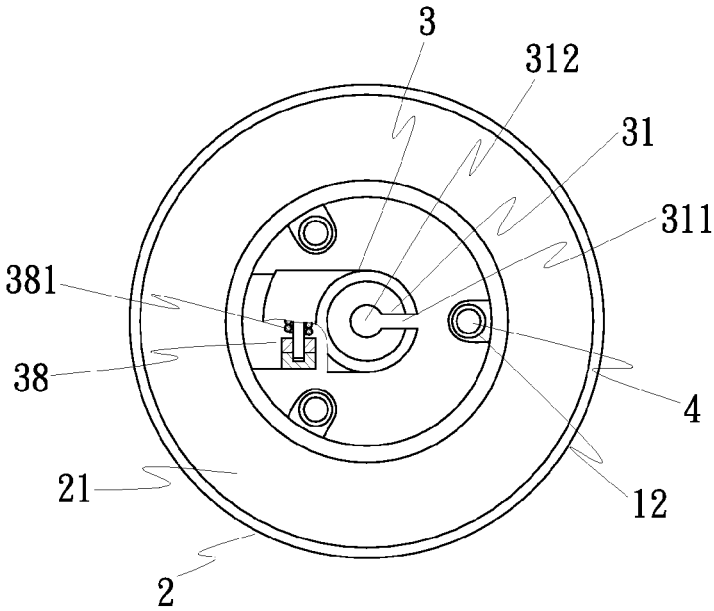
FIG. 12 is a top view of FIG. 11.
Figure 13:
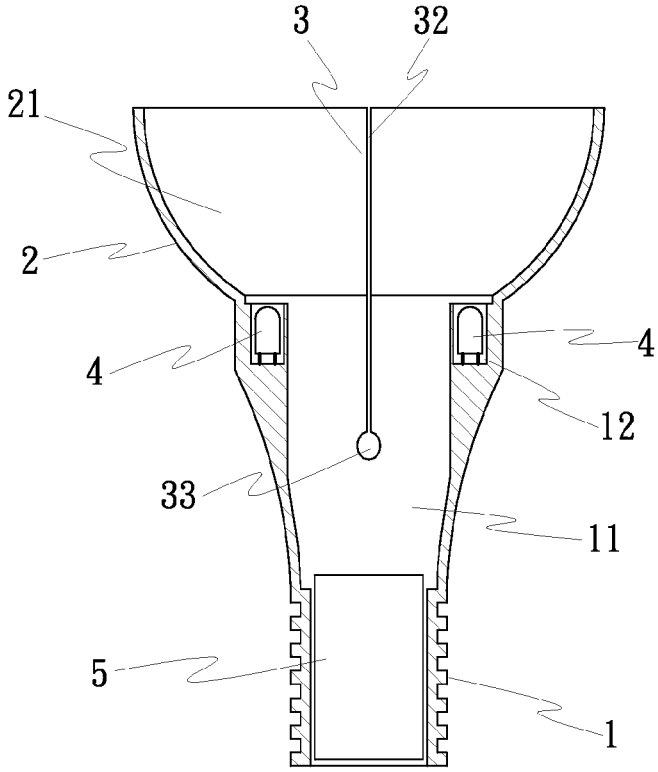
FIG. 13 is a schematic sectional view of a balloon lamp in accordance with a sixth embodiment of the present invention (before installation of a balloon).
Figure 14:
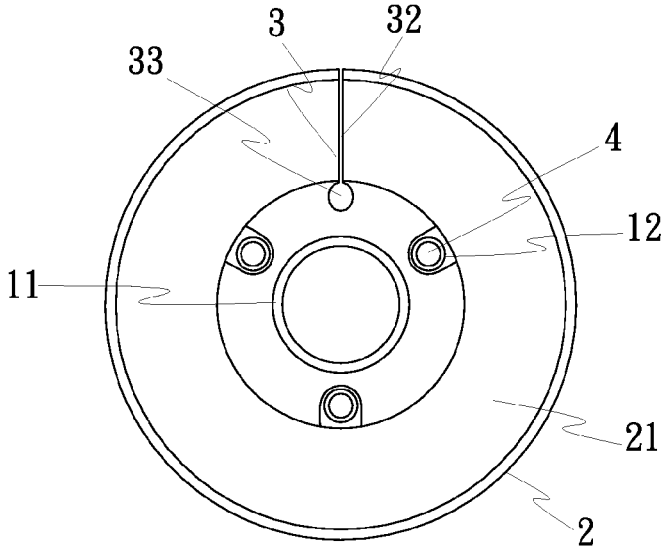
FIG. 14 is a top view of FIG. 13.

Further, the balloon connector 3, as shown in FIG. 1, is fixedly mounted in the recessed chamber 21 inside the balloon shade 2. The balloon connector 3 may be formed integral with or detachably fastened to the balloon shade 2 (see FIGS. 4 and 5). The balloon connector 3 can be made in the form of a conical disk and fastened with its one side to the inside of the recessed chamber 21 of the balloon shade 2. The arrangement of the balloon shade 2 and the balloon connector 3 may be variously embodied. According to the embodiment shown in FIGS. 13 and 14, the balloon connector 3 is formed integral with a part of the balloon shade 2, i.e., the balloon shade 2 has a narrow notch 32 radially and upwardly extending to the border edge, and a through hole 33 at the inner end of the narrow notch 32 for securing the balloon 6. According to the embodiment shown in FIGS. 6 and 7, the balloon connector 3 is provided with a weight 34 for securing the balloon to the recessed chamber 21 of the balloon shade 2. According to the embodiment shown in FIG. 8, the balloon connector 3 is detachably secured to the balloon shade 2, i.e., the balloon connector 3 has a ferrous block 35 fixedly secured thereto, and a magnetic member (magnet) 36 is set in the chamber 11 of the holder base 1 or the recessed chamber 21 of the balloon shade 2 to secure the ferrous block 35 of the balloon connector 3 by means of magnetic attraction. According to the embodiment shown in FIGS. 9 and 10, the balloon connector 3 is vertically movably secured to the balloon shade 2, i.e., the balloon connector 3 has a pull rod 37 vertically downwardly extending from its bottom side and inserted into the chamber 11 of the holder base 1 and a control member 371 extending out of the holder base 1 for operation by the user to move the pull rod 37 vertically upwards or downwards. According to the embodiment shown in FIGS. 11 and 12, a hinge 38 is used to hinge the balloon connector 3 to the balloon shade 2 inside the recessed chamber 21 and a torsion spring 381 is mounted in the hinge 38 to impart a pressure to the balloon connector 3 for holding the balloon connector 3 in position. By means of any of the aforesaid various mounting arrangement of the balloon connector 3, the installation of the balloon 6 is simple.

Figure 5:
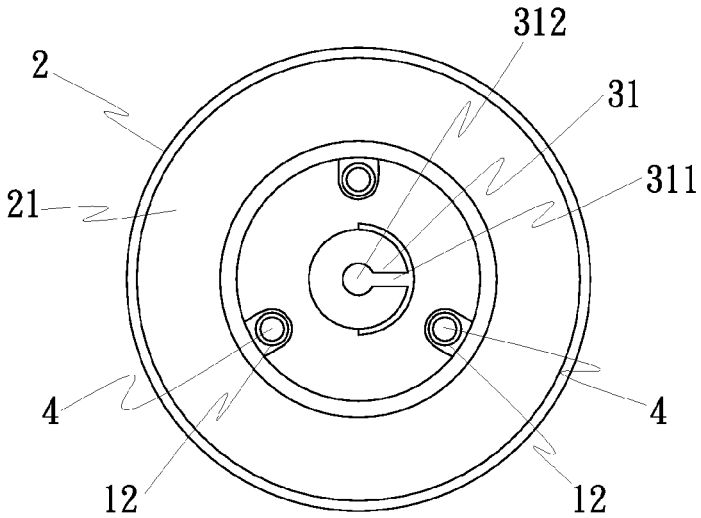
FIG. 5 is a top view of FIG. 4.

The LEDs (light emitting diodes) 4, as shown in FIG. 1, are mounted in the recessed chamber 21 of the balloon shade 2, and can be controlled or adjusted to emit light upon or through the balloon 6 (see FIG. 3) in a desirable manner. Preferably, the balloon shade 2 comprises a plurality of lamp holes 25 in the recessed chamber 21, and the LEDs 4 are respectively mounted in the lamp holes 25 and aimed at the balloon 6. Alternatively, as shown in FIGS. 4 and 5, lamp holes 12 are formed in the holder base 1 inside the chamber 11 and disposed in communication with the recessed chamber 21, and the LEDs 4 are respectively mounted in the lamp holes 12 and aimed at the balloon 6.

The power supply unit 5, as shown in FIG. 1, is mounted in the holder base 1 and electrically connected to the LEDs 4. The power supply unit 5 can be a DC power module (battery pack) to provide DC power to the LEDs 4 directly. Alternatively, the power supply unit 5 can be a power adapter that converts AC power supply into DC power supply for the LEDs 4.

Figure 3:
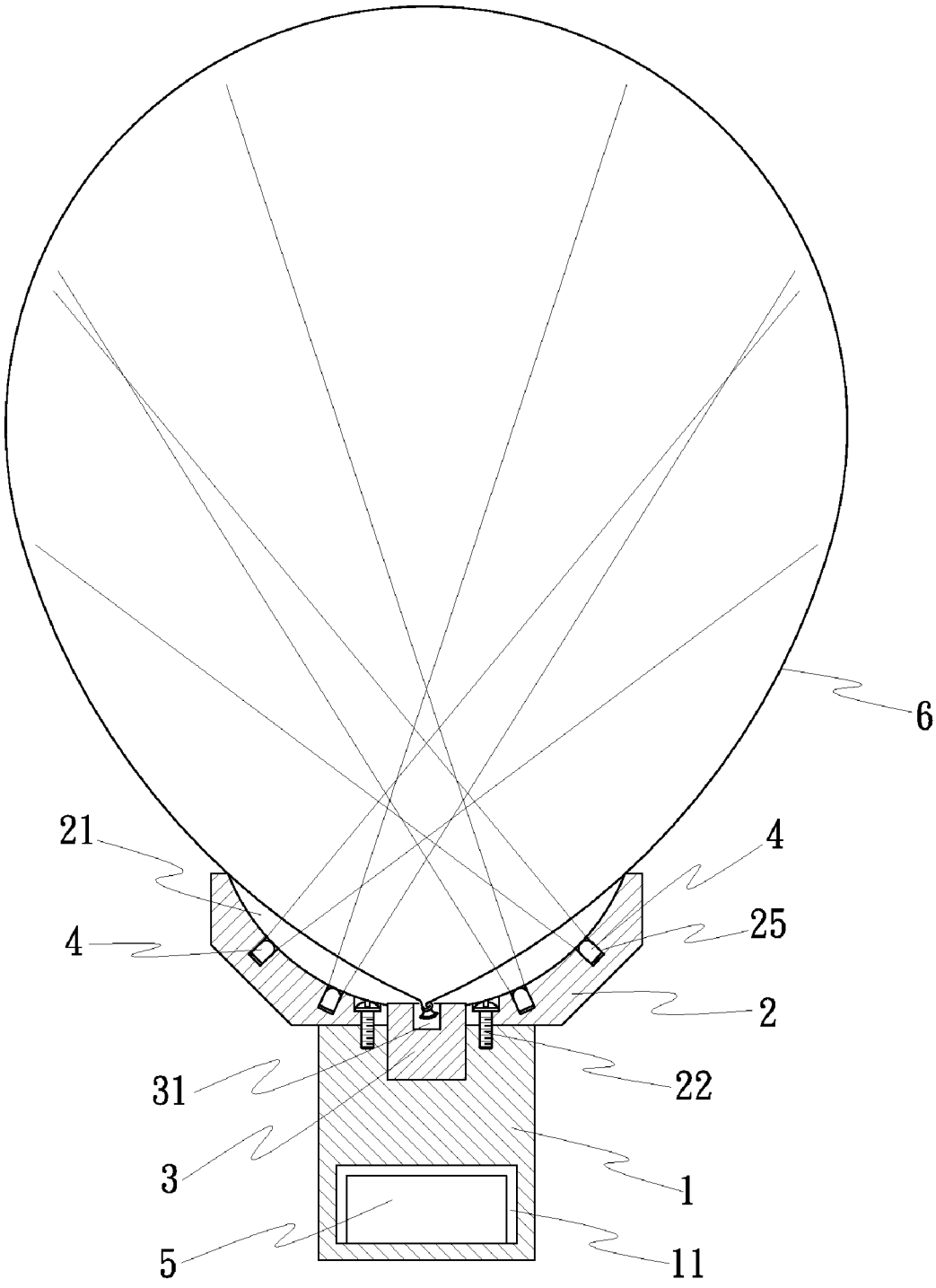
FIG. 3 corresponds to FIG. 1, showing a balloon fastened to the balloon connector.

Subject to the structural characteristics and space design of the aforesaid holder base 1, balloon shade 2, balloon connector 3, LEDs 4, power supply unit 5 and balloon 6, a balloon lamp is set up according to the present invention. To use the balloon lamp, as shown in FIG. 3, the balloon 6 is filled with a gas and then tied to the connecting portion 31 of the balloon connector 3 and received in the recessed chamber 21 of the balloon shade 2. When the power supply unit 5 is switched on to provide the necessary working voltage to the LEDs 4, the LEDs 4 are turned on to emit light toward the balloon 6, thus producing a lighting effect. Further, the low temperature and long working life of the LEDs 4 allow the balloon 6 to be arranged in proximity to the LEDs 4. Further, the arrangement of the balloon shade 2 and the balloon connector 3 facilitates mounting and dismounting of the balloon 6. The balloon lamp of the present invention is practical for use as a decorative item on a special occasion such as a wedding ceremony, a birthday party, etc., to create a unique atmosphere through the lighting effect.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A balloon lamp, comprising:

a holder base;

a balloon shade connected to said holder base, said balloon shade having a recessed chamber adapted for receiving a balloon;

a balloon connector provided in the recessed chamber of said balloon shade, said balloon connector having means to secure a balloon to the inside of the recessed chamber of said balloon shade;

a light source formed of at least one light emitting diode and mounted in either said holder base or said balloon shade for emitting light toward the balloon secured to said balloon connector; and a power supply unit mounted in said holder base and electrically connected to said light source.

2. The balloon lamp as claimed in claim 1, wherein said balloon connector comprises a conical disk, said conical disk having a through hole and a narrow notch radially extending from said through hole to a periphery of said conical disk for securing a balloon.

3. The balloon lamp as claimed in claim 1, wherein said holder base has a chamber in communication with the recessed chamber of said balloon shade; and said balloon connector is mounted in the recessed chamber of said balloon shade corresponding to the chamber of said holder base.

4. The balloon lamp as claimed in claim 1, wherein said power supply unit is a DC power module.

5. The balloon lamp as claimed in claim 1, wherein said power supply unit is a power adapter for converting AC power supply into DC power supply.

6. The balloon lamp as claimed in claim 1, wherein said balloon connector is formed integral with a part of said balloon shade.

7. The balloon lamp as claimed in claim 6, wherein said balloon connector has a through hole cut through a top side and a bottom side of said balloon shade and a narrow notch radially extending from said through hole to a periphery of said balloon shade for securing a balloon.

8. The balloon lamp as claimed in claim 6, wherein said balloon connector is a conical disk formed integral with a part of the recessed chamber of said balloon shade.

9. The balloon lamp as claimed in claim 1, wherein said balloon connector is connected to said balloon shade by a connecting means that allows movement of said balloon connector relative to said balloon shade.

10. The balloon lamp as claimed in claim 9, wherein said connecting means comprises a weight fixedly provided at a bottom side of the balloon connector and positioned in the recessed chamber of said balloon shade by means of gravity weight.

11. The balloon lamp as claimed in claim 9, wherein said connecting means comprises a pull rod downwardly extending from said balloon connector and inserted into said chamber of said holder base, and a control member extending out of one of said balloon shade and said holder base and operable to move said pull rod and said balloon connector vertically up and down.

12. The balloon lamp as claimed in claim 9, wherein said connecting means comprises a ferrous block fixedly provided at a bottom side of said balloon connector, and a magnetic member mounted in one of said balloon shade and said holder base and adapted to secure said ferrous block by means of magnetic attraction.

13. The balloon lamp as claimed in claim 9, wherein said connecting means comprises a hinge that connects said balloon connector to said balloon shade, and a torsion spring mounted in said hinge and adapted for imparting a pressure to said balloon connector against said balloon shade.

* * * * *